US007267405B2

(12) United States Patent
Tin

(10) Patent No.: US 7,267,405 B2
(45) Date of Patent: Sep. 11, 2007

(54) CHAIR WITH A SYNCHRONOUS COORDINATING SYSTEM FOR THE CHAIR BACK

(76) Inventor: Yu Yeung Tin, Room 1823, Hing Shing House, Tai Hing Estate, Tuen Nun, N.T. (HK)

( * ) Notice: Subject to any disclaimer, the term of this patent is extended or adjusted under 35 U.S.C. 154(b) by 0 days.

(21) Appl. No.: 11/156,935

(22) Filed: Jun. 20, 2005

(65) Prior Publication Data

US 2005/0280300 A1 Dec. 22, 2005

(30) Foreign Application Priority Data

Jun. 21, 2004 (HK) ..... 1064859

(51) Int. Cl.
*A47C 1/024* (2006.01)
*A47C 1/038* (2006.01)
*A47C 3/026* (2006.01)

(52) U.S. Cl. ..... 297/300.2; 297/300.1; 297/300.3; 297/300.5; 297/316

(58) Field of Classification Search ..... 297/300.2, 297/316, 300.1, 300.3, 300.5
See application file for complete search history.

(56) References Cited

U.S. PATENT DOCUMENTS 4,270,797 A * 6/1981 Brauning ..... 297/300.3
4,682,814 A * 7/1987 Hansen ..... 297/300.3
4,703,974 A * 11/1987 Brauning ..... 297/285
4,840,426 A * 6/1989 Vogtherr et al. ..... 297/300.5
4,848,837 A * 7/1989 Volkle ..... 297/300.1
5,354,120 A 10/1994 Volkle
6,283,548 B1 * 9/2001 Husemann ..... 297/300.1
6,523,895 B1 * 2/2003 Vogtherr ..... 297/300.1
6,523,898 B1 * 2/2003 Ball et al. ..... 297/320
6,557,939 B1 * 5/2003 Brauning ..... 297/316
6,572,191 B2 * 6/2003 Wild ..... 297/300.1 X
6,588,845 B2 * 7/2003 Wilkerson et al. ..... 297/300.2
6,695,404 B2 2/2004 Bruske
6,698,833 B2 * 3/2004 Ball et al. ..... 297/284.7
6,820,936 B2 * 11/2004 Wilkerson et al. ..... 297/300.2

(Continued)

FOREIGN PATENT DOCUMENTS

CN 2066271 U 11/1990

(Continued)

*Primary Examiner*—Rodney B. White
(74) *Attorney, Agent, or Firm*—McDonnell Boehnen Hulbert & Berghoff LLP

(57) ABSTRACT

A chair with a synchronous coordinating system for the chair back includes a base, a chair cushion and a chair back. The base and the chair cushion are connected fixedly or formed integrally, and the chair back is articulated with the base which is articulated with the chair back through an upright column extended above the chair cushion. The articulated point is located at the trochanter (the center point of the hip joint) of the human body. The chair cause the turning (pitched or inclined) pivot of the chair back and the human body on the same line by providing the articulated point of the chair back and the base at the trochanter of the human body in the pitching movement. No matter how the angle of the chair back is adjusted, the contact surface between the backside of the human body and the chair back will not be changed so that the chair back can provide sufficient supporting force to the waist at any angle and the person on the chair will not feel uncomfortable.

19 Claims, 2 Drawing Sheets

U.S. PATENT DOCUMENTS

| | | | | |
|---|---|---|---|---|
| 6,874,853 | B2 * | 4/2005 | Wild | 297/300.2 |
| 6,913,315 | B2 * | 7/2005 | Ball et al. | 297/284.7 |
| 7,159,943 | B2 * | 1/2007 | Costaglia | 297/316 X |
| 2002/0109384 | A1 * | 8/2002 | Hansen | 297/300.1 |
| 2004/0195881 | A1 * | 10/2004 | Wells | 297/300.2 X |
| 2006/0244294 | A1 * | 11/2006 | Dozsa-Farkas | 297/300.2 |

FOREIGN PATENT DOCUMENTS

| | | | |
|---|---|---|---|
| CN | 2165075 | Y | 11/1990 |
| CN | 2066271 | U | 5/1994 |
| CN | 2165075 | Y | 5/1994 |
| CN | 2438377 | Y | 7/2001 |
| GB | 2 125 284 | | 3/1984 |
| GB | 2 206 784 | | 1/1989 |
| JP | 10-127399 | | 5/1998 |

* cited by examiner

CHAIR WITH A SYNCHRONOUS COORDINATING SYSTEM FOR THE CHAIR BACK

BACKGROUND OF THE INVENTION

1. Field of the Invention

The invention relates to a chair, more specifically, to a chair with a synchronous coordinating system for the chair back, wherein the synchronous coordinating system can be cooperated with the rotation of the human body.

2. Discussion of the Related Art

Presently, there are two connection modes for the chair cushion and the chair back. One is the chair whose chair cushion and chair back are connected fixedly and can not rotated each other, such as most of the chairs for the dining table, which is only adapted to use for a short time. The other is the chair with the adjustable-angle chair back, which is adapted to the office chair seated for a long time. Since such chair can not only be seated but also provides a supporting force to the upper part and the waist of the human body by means of the chair back, the correct posture of the waist of the human body can be kept and the tiredness of the waist can be reduced. In the meantime, the angle between the chair back and the chair cushion can be adjusted according to different requirements (the angles of the chair back and the chair cushion can be adjusted as a whole), so that the chair is facilitative to be used.

However, such chair has some structures designed improper, thus once the angle of the chair back is rotated in use, the position for supporting the waist of the human body will be changed. Therefore the chair can not support the upper part and the waist of the human body sufficiently. Additionally, friction will be generated between the chair back and the waist, which makes the backside of the human body uncomfortable (for example, the clothing of the person can be drawn away by the friction).

For this, the invention provides a chair with a synchronous coordinating system for the chair back so as to solve the problems of the present chairs effectively.

SUMMARY OF THE INVENTION

A main object of the invention is to provide a chair with a synchronous coordinating system for the chair back. No matter how the angle of the chair back is adjusted, the contact surface between the backside of the human body and the chair back will not be changed, so that the chair back can provide sufficient supporting force to the waist at any angle and the person on the chair will not feel uncomfortable.

The chair with a synchronous coordinating system for the chair back according to the invention includes a base, a chair cushion and a chair back. The base and the chair cushion are united. The chair back is articulated with the base. The base is articulated with the chair back through at least one upright column extending out above the chair cushion, and the articulate point is located at the trochanter of the human body. A slide rail is provided on the upright column. A slide block is embedded in the inner of the slide rail and can be located at any height. The slide block is articulated with the chair back.

Two upright columns, which extend out above the chair cushion and are articulated with the chair back, are fixed at two sides of the base respectively.

One upright column, which extends out above the chair cushion and is articulated with the chair back, is fixed at one side of the base.

The chair back includes a back cushion and a supporter for supporting the back cushion and articulating with the upright column.

The supporter includes two rocking arms, a connecting rod for connecting said two rocking arms, and an upright rod for fixing the chair back. Said two rocking arms and the connecting rod form a U-shape frame. The upright rod and the connecting rod are connected fixedly.

The supporter includes one rocking arm, which is articulated with the upright rod and connected fixedly with the chair back by a connecting rod.

An arm rest extending upwardly and used for placing an arm is provided fixedly on the rocking arm.

A control device for controlling the pitch angle of the chair back is provided between the chair back and the base.

The control device includes: a cylinder articulated with the base and located under the chair cushion, and a piston extending out of the cylinder and connecting with the chair back. The piston is articulated with the chair back.

The base and the chair cushion are formed integrally.

The base and the chair cushion are connected fixedly.

The chair with a synchronous coordinating system for the chair back according to the invention cause the turning (pitched or inclined) pivot of the chair back and the human body on the same line by providing the articulated point of the chair back and the base at the trochanter of the human body in the pitching movement. No matter how the angle of the chair back is adjusted, the contact surface between the backside of the human body and the chair back will not be changed so that the chair back can provide sufficient supporting force to the waist at any angle and the person on the chair will not feel uncomfortable.

DETAILED DESCRIPTION OF THE INVENTION

Figure 1:
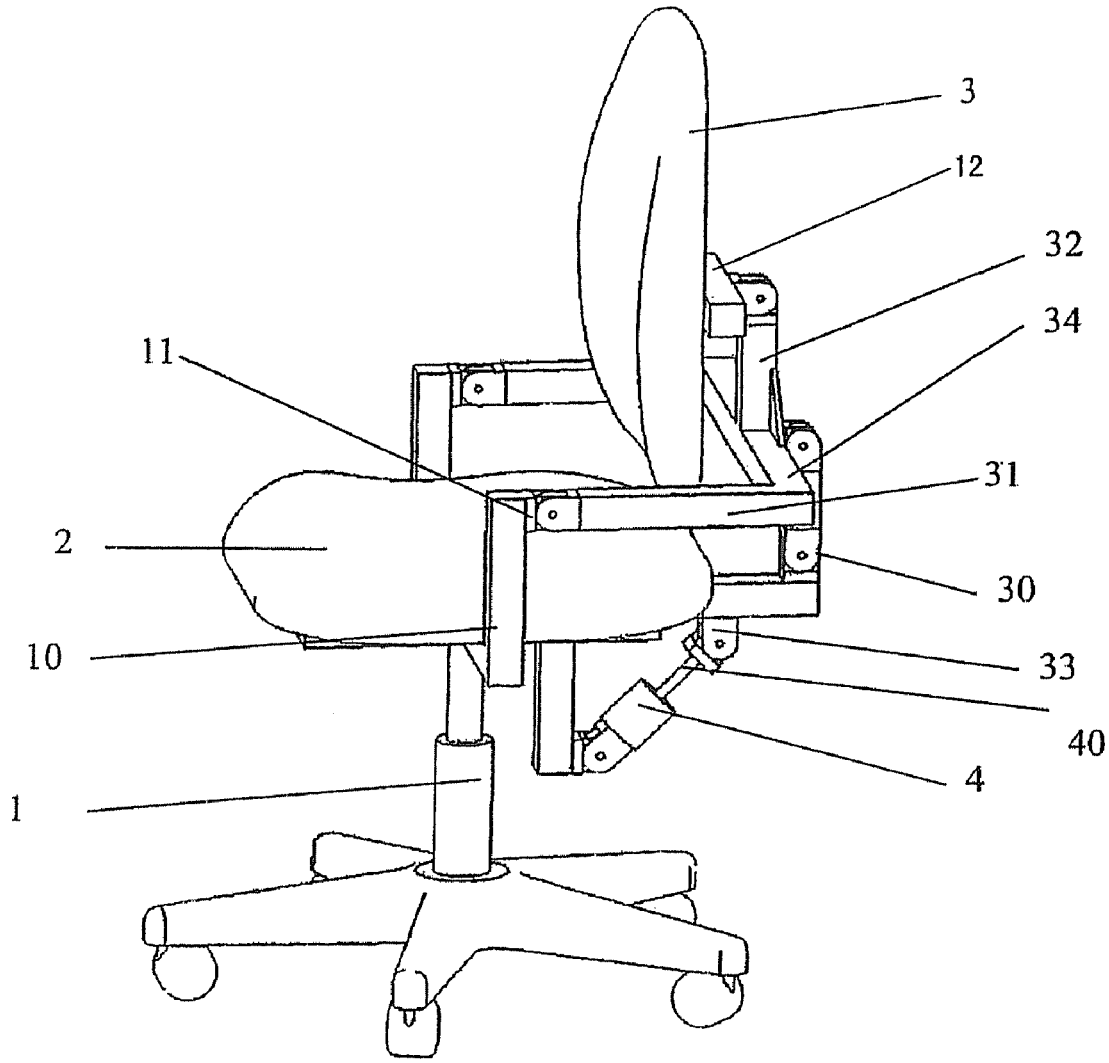
FIG. 1 shows a schematic structure of the chair with a synchronous coordinating system for the chair back according to the invention.

As shown in FIG. 1, the chair with a synchronous coordinating system for the chair back includes a base 1, a chair cushion 2 and a chair back 3. The base 1 and the chair cushion 2 are connected fixedly. Alternatively, the base 1 and the chair cushion 2 may be formed integrally. The base 2, the chair cushion 2 and the chair back 3 are structured according to the present chair.

Two upright columns 10 are fixed in the rear of the centre of the base 1 respectively with any connection mode, such as threaded connection and welded connection etc.

A supporter 12 is connected fixedly with the rear part of the chair back 3 by the mode of threaded connection or welded connection etc., and articulated with an upright rod 32. The upright rod 32 is connected with a connecting rod 34 which is connected with two parallel rocking arms 31, the upright rod 32 for connecting to the chair back 3 and a connecting rod 30 for connecting to the base 1. The connecting rod 34 and the two rocking arms 31 form a U-shape frame, whose two ends are articulated with the end far away from the base 1 of the upright column 10. The middle part of the connecting rod 34 is connected fixedly with the upright rod 32 and articulated with the upright rod 33. The upright rod 33 is articulated with the base 1.

A slide rail 22 is provided inside of the upright column 10. A slide block 11 is embedded in the slide rail and can be fastened at any height on the slide rail, so that the height of the slide block 11 can be adjusted according to the trochanters (the centre points of the hip joints) of different humans.

The structures with the functions for locating and sliding between the slide block 11 and the slide rail are know in the art, thus the detailed explanation will not be illuminated here. The end extending out of the slide rail of slide block 11 is articulated with the rocking arm 31, so that the U-shape frame can be rotated around the slide block 11 as a pivot, and then drive the chair back 3 to rotate, thus the adjustment of the angle between the chair back 3 and the base 1 can be achieved. Since the turning pivot for rotating the chair back and the pivot for adjusting the pitching angle of the human body are on the same line, the contact point between the backside of the human body and the chair back will not be changed.

As shown in FIG. 1, arm rests can be provided on the two rocking arms 31 with threaded connection or welded connection. When the person place his/her arm on the arm rests, the upper part of the human body can be inclined and swung with the rotation of the chair back 3. Friction will not be generated between the human body and the chair, so that the person can stand in the most comfortable state.

Figure 2:
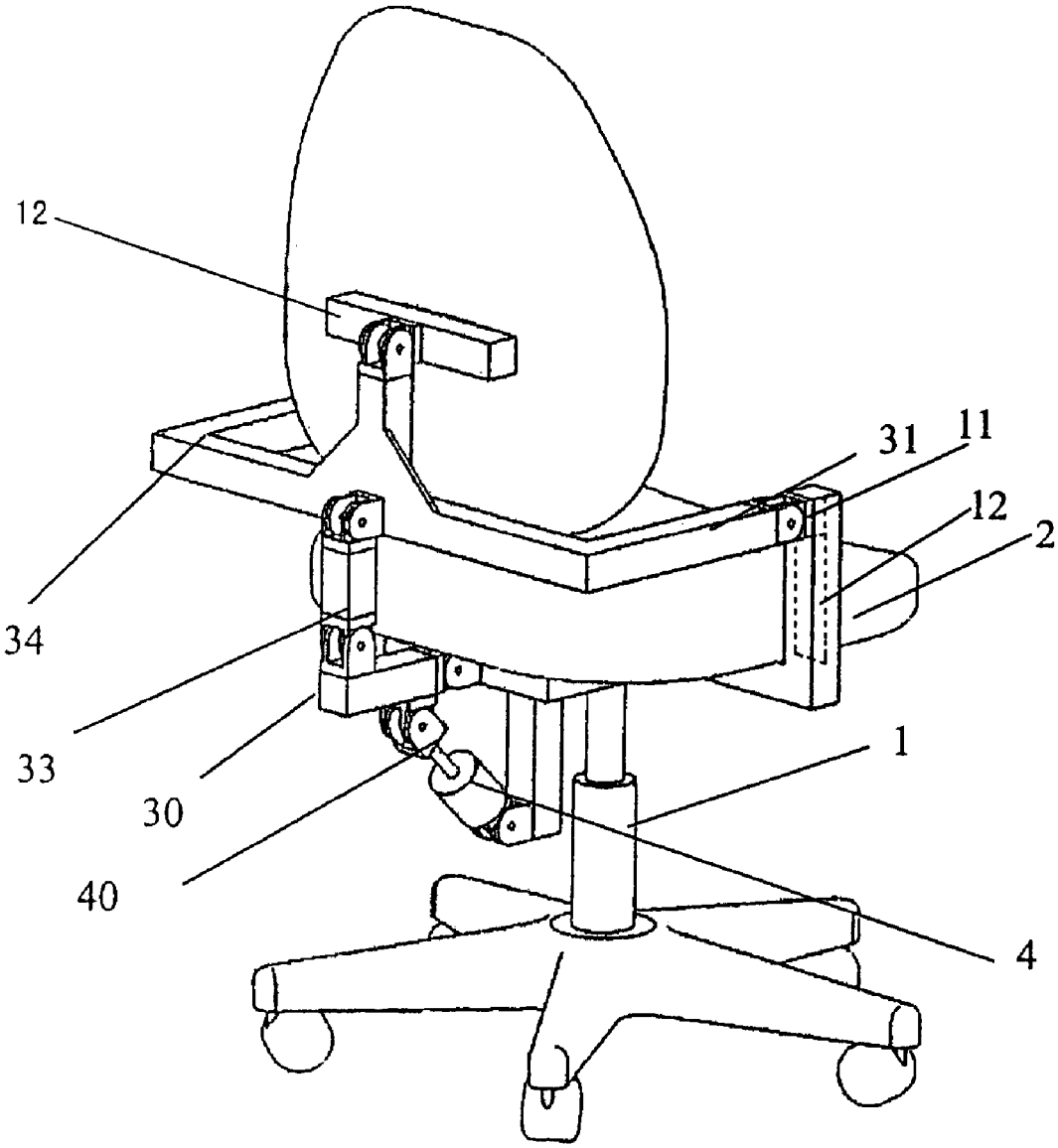
FIG. 2 shows a schematic structure of the chair with a synchronous coordinating system for the chair back according to the invention from another visual angle.

As shown in FIGS. 1 and 2, an air cylinder 4 (or a hydraulic cylinder) is connected between the connecting rod 33 and the base 1 and connected fixedly on the base 1. A piston 40 extending out of the air cylinder is articulated with the connecting rod 33 so as to control the rotation angle of the chair back and provide the stability while the chair back is rotated. In addition, the mechanical structures of the present chair can be used for the control device for controlling the pitch angle of the chair back. Since the mechanical structures are known, the detailed explanation will not be illuminated here.

Alternatively, one upright rod 10 can be provided on one side of the base 1. A end far away from the base 1 of the upright rod 10 is articulated with a rocking arm 31, which is connected fixedly with the chair back 3 through a connecting rod. This structure can also achieve the angle adjustment of the chair back.

Furthermore, the base, chair cushion and chair back of the chair according to the invention can be selected from the office chair, automobile chair, luxury chair, plane chair, outdoor beach chair, operating chair and massage chair so as to constitute the chair used for different situations.

What is claimed is:

1. A chair with a synchronous coordinating system for the chair back including a base, a chair cushion and a chair back, wherein the base and the chair cushion are united; the chair back is articulated with the base; the base is articulated with the chair back through at least one upright column extending out above the chair cushion; and an articulate point of the upright column and the chair back is located at the trochanter of the human body; wherein, a slide rail is provided on the upright column, and a slide block, which is embedded inside the slide rail and can be located at any height, is articulated with the chair back.

2. A chair with a synchronous coordinating system for the chair back according to claim 1, wherein two upright columns are fixed at two sides of the base respectively.

3. A chair with a synchronous coordinating system for the chair back according to claim 2, wherein the chair back includes a back cushion and a supporter for supporting the back cushion and articulating with the upright column.

4. A chair with a synchronous coordinating system for the chair back according to claim 3, wherein the supporter includes two rocking arms, a connecting rod for connecting said two rocking arms, and an upright rod for fixing the back cushion, said two rocking arms and the connecting rod form a U-shape frame, the upright rod and the connecting rod are connected fixedly.

5. A chair with a synchronous coordinating system for the chair back according to claim 4, wherein an arm rest extending upwardly and used for placing an arm is provided fixedly on the rocking arm.

6. A chair with a synchronous coordinating system for the chair back according to claim 3, wherein the supporter includes one rocking arm, which is connected fixedly with the back cushion.

7. A chair with a synchronous coordinating system for the chair back according to claim 2, wherein a control device for controlling the pitch angle of the chair back is provided between the chair back and the base.

8. A chair with a synchronous coordinating system for the chair back according to claim 7, wherein the control device includes a cylinder articulated with the base and located under the chair cushion and a piston extending out of the cylinder and connecting with the chair back, and the piston is articulated with the chair back.

9. A chair with a synchronous coordinating system for the chair back according to claim 2, wherein the base and the chair cushion are connected fixedly.

10. A chair with a synchronous coordinating system for the chair back according to claim 2, wherein the base and the chair cushion are formed integrally.

11. A chair with a synchronous coordinating system for the chair back according to claim 1, wherein one upright column is fixed at one side of the base.

12. A chair with a synchronous coordinating system for the chair back according to claim 11, wherein the chair back includes a back cushion and a supporter for supporting the back cushion and articulating with the upright column.

13. A chair with a synchronous coordinating system for the chair back according to claim 12, wherein the supporter includes two rocking arms, a connecting rod for connecting said two rocking arms, and an upright rod for fixing the back cushion, said two rocking arms and the connecting rod form a U-shape frame, the upright rod and the connecting rod are connected fixedly.

14. A chair with a synchronous coordinating system for the chair back according to claim 13, wherein an arm rest extending upwardly and used for placing an arm is provided fixedly on the rocking arm.

15. A chair with a synchronous coordinating system for the chair back according to claim 12, wherein the supporter includes one rocking arm, which is connected fixedly with the back cushion.

16. A chair with a synchronous coordinating system for the chair back according to claim 11, wherein a control device for controlling the pitch angle of the chair back is provided between the chair back and the base.

17. A chair with a synchronous coordinating system for the chair back according to claim 16, wherein the control device includes a cylinder articulated with the base and located under the chair cushion and a piston extending out of the cylinder and connecting with the chair back, and the piston is articulated with the chair back.

18. A chair with a synchronous coordinating system for the chair back according to claim 11, wherein the base and the chair cushion are connected fixedly.

19. A chair with a synchronous coordinating system for the chair back according to claim 11, wherein the base and the chair cushion are connected fixedly.

* * * * *